United States Patent [19]

Nakayama

[11] Patent Number: 4,700,389

[45] Date of Patent: Oct. 13, 1987

[54] STEREO SOUND FIELD ENLARGING CIRCUIT

[75] Inventor: Kazuaki Nakayama, Tokyo, Japan

[73] Assignee: Pioneer Electronic Corporation, Tokyo, Japan

[21] Appl. No.: 828,796

[22] Filed: Feb. 12, 1986

[30] Foreign Application Priority Data

Feb. 15, 1985 [JP] Japan ..... 60-26463
Feb. 20, 1985 [JP] Japan ..... 60-30235

[51] Int. Cl.[4] ..... H04R 5/00
[52] U.S. Cl. ..... 381/1
[58] Field of Search ..... 381/1, 17, 27, 18

[56] References Cited

U.S. PATENT DOCUMENTS 4,349,698 9/1982 Iwahara ..... 381/1

*Primary Examiner*—Forester W. Isen
*Attorney, Agent, or Firm*—Sughrue, Mion, Zinn, Macpeak, and Seas

[57] ABSTRACT

In a stereo sound field enlarging circuit, signals A and B applied to left and right input terminals are suitably processed so that signals A′ and B′ represented by the following equations are provided at respective left and right output terminals:

$$A' = |A|_{LPF} + K(A-B)$$

$$B' = |B|_{LPF} + K(B-A)$$

where $|A|_{LPF}$ ($|B|_{LPF}$) is the A (B) signal passed through a low-pass filter, and K is a constant.

7 Claims, 14 Drawing Figures

STEREO SOUND FIELD ENLARGING CIRCUIT

BACKGROUND OF THE INVENTION

The present invention relates to a stereo sound field enlarging circuit for enlarging a stereo sound field.

A conventional stereo sound field enlarging circuit is arranged as shown in FIG. 1. In the circuit, the difference signal between two signals A and B, which are applied to respective left and right input channel input terminals L and R, is obtained. The difference signal thus obtained is applied to a sound field enlarging circuit, composed of a delay circuit having a delay time $\tau$ and a phase shifter imposing a phase shift $\psi$, so that it is phase-shifted and time-delayed. The resultant signals are added, in an optional ratio, to the respective original left and right channel input signals A and B, as a result of which left and right output signals A′ and B′ are provided.

When reproduced, these signals cause the listener to perceive the reproduced sound as if the sound field were enlarged.

However, the delay circuit and the phase shifter of the sound field enlarging circuit 1 are intricate components and accordingly high in manufacturing cost. Especially, a circuit employing a BBD (bucket-brigade device) as the delay circuit has a considerably high manufacturing cost. Furthermore, perceived natural enlargement of the sound field cannot be obtained without setting the delay time $\tau$ and the amount of phase shift $\psi$ to suitable values, which are difficult to determine, and it is considerably difficult to obtain an output from the circuit 1 of sufficient bandwidth to select addition ratio. Especially in a circuit using a BBD, the bandwidth is narrow, and the amount of data available to characterize the directivity of the reproduced sound is small.

SUMMARY OF THE INVENTION

Accordingly, an object of the invention is to eliminate the above-described difficulties accompanying a conventional stereo sound field enlarging circuit.

More specifically, an object of the invention is to provide a stereo sound field enlarging circuit which is simple in construction, has a low manufacturing cost, and which is effective to produce perceived natural enlargement of the sound field.

The foregoing object and other objects of the invention have been achieved by the provision of a stereo sound field enlarging circuit in which, according to the invention, signals A and B, two input channel signals, are processed to provide signals A′ and B′ at two respective output terminals, the signals A′ and B′ being represented by the following equations:

$$A' = |A|_{LPF} + K(A-B)$$

$$B' = |B|_{LPF} + K(B-A)$$

where $|A|_{LPF}$ ($|B|_{LPF}$) is the signal A (B) passed through a low-pass filter, and K is a constant.

The nature, principle and utility of the invention will become more apparent from the following detailed description and the appended claims when read in conjunction with the accompanying drawings.

DESCRIPTION OF THE PREFERRED EMBODIMENTS

Preferred embodiments of the invention will be described with reference to the accompanying drawings.

Figure 1:
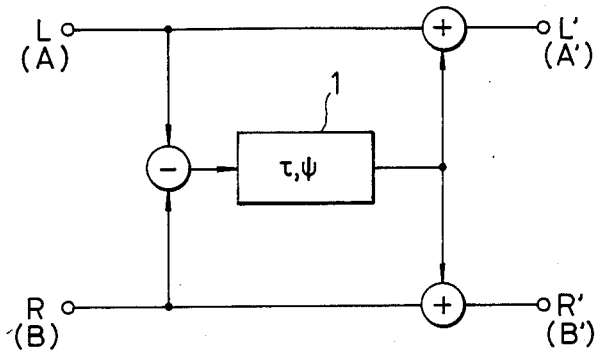
FIG. 1 PRIOR ART
FIG. 1 is a block diagram showing an example of a conventional stereo sound field enlarging circuit.
Figure 2:
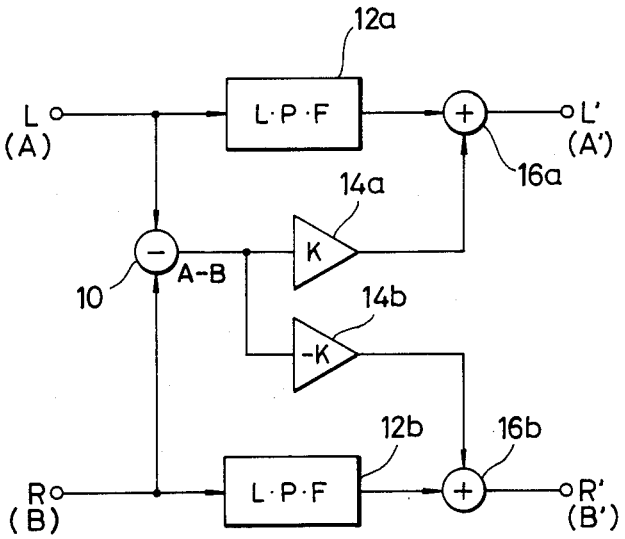
FIG. 2 is a block diagram showing an example of a stereo sound field enlarging circuit according to the invention.

FIG. 2 shows an example of a stereo sound field enlarging circuit according to the invention. In FIG. 2, reference characters L and R designate input terminals to which left and right channel signals A and B of a stereo signal are respectively applied; L′ and R′, output terminals to which respective left and right channel signals A′ and B′, namely, the input stereo signals after being subjected to sound field enlarging processing, are applied; 10, a difference signal circuit for obtaining as a difference signal the difference between the left and right channel signals A and B applied respectively to the input terminal L and R; 12*a* and 12*b*, low-pass filters having a lag-lead characteristic, the low-pass filters attenuating the harmonic components of the left and right channel signals A and B applied to the input terminals L and R, respectively; 14*a* and 14*b*, constant multiplier circuits; and 16*a* and 16*b*, adder circuits. In each of the constant multiplier circuits 14*a* and 14*b*, the difference signal received from the difference signal circuit 10 is multiplied by a constant, and the resulting output is applied to the respective adder circuit. The constant multiplier circuit 14*b* operates also as a phase inverting circuit. In the adder circuit 16*a*, the output signal of the low-pass filter 12*a* is added to the output signal of the constant multiplier circuit 14*a*, and the addition result is applied as the left channel signal A′ to the output terminal L′. Similarly, in the adder circuit 16*b*, the output signal of the low-pass filter 12*b* is added to the output signal of the constant multiplier (phase inverting) circuit 14*b*, and the result of addition is applied as the right channel signal B′ to the output terminal R′. Accordingly, channel signals A′ and B′ represented by the following equations (1) and (2) are applied to the output terminals L′ and R′, respectively:

$$A' = |A|_{LPF} + K(A-B) \quad (1)$$

$$B' = |B|_{LPF} + K(B-A) \quad (2)$$

where $|A|_{LPF}$ ($|B|_{LPF}$) is the signal A (B) passed through the low-pass filter 12*a* (12*b*), and K is the multiplier constant.

Figure 3:
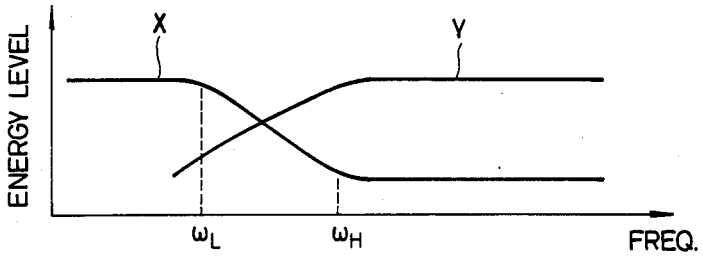
FIG. 3 is a graphical representation indicating levels of signals processed in the circuit of FIG. 1.

FIG. 3 is a graphical representation indicating the frequency distribution of the channel signals A′ and B′ provided respectively at the output terminals L′ and R′. In this graphical representation, the localization signal components $|A|_{LPF}$ and $|B|_{LPF}$ passed through the low-pass filters 12*a* and 12*b* are indicated by X, and the difference signal components K(A−B) and K(B−A) by Y. Further in FIG. 3, $W_L$ and $W_R$ designate the lower and upper frequency limits of the cutoff range provided when the low-pass filters 12*a* and 12*b* are of the lag-lead type. Since little low frequency components are included in the difference signal, the curve Y drops in the low frequency range.

In the sound field enlarging circuit constructed as described above, the delay component and the reverbration component included in the difference signal provide the perception of sound field enlargement, and the perception of sound field enlargement is increased by applying the difference signal component to the two channels. However, as a larger part of the difference signal component is distributed over a range of frequencies higher than 300–1,000 Hz, addition of the difference signal component to each channel signal strongly breaks the sound range balance. On the other hand, if the difference signal component is increased, then the low frequency component and the central localization component (containing the frequencies of the human voice, for instance) are eliminated. For this reason, the low-pass filters 12*a* and 12*b* are employed. Therefore, addition of the difference signal component to the channel signals passed through the lag-lead characteristic low-pass filters, which transmit frequencies lower than 300–1,000 Hz, provides a sound field clear in central localization without disturbing the sound range balance.

Figure 4:
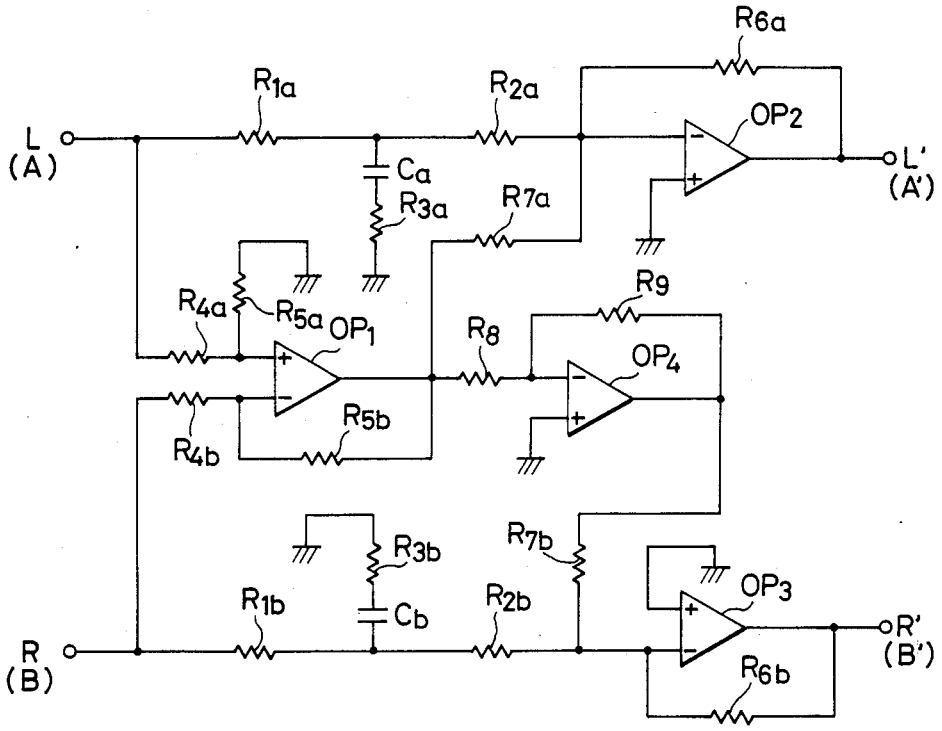
FIG. 4 is a circuit diagram, partly in the form of a block diagram, showing a specific implementation of the circuit of FIG. 2.

FIG. 4 shows the stereo sound field enlarging circuit of FIG. 2 in more detail. In FIG. 4, an operational amplifier $OP_1$ and resistors $R_{4a}$, $R_{4b}$, $R_{5a}$ and $R_{5b}$ form a difference signal circuit, operational amplifiers $OP_2$ and $OP_3$ form respective adder circuits, an operational amplifier $OP_4$ and resistors $R_8$ and $R_9$ form a phase inverting circuit, resistors $R_{1a}$, $R_{2a}$ and $R_{3a}$ and a capacitor $C_a$ form a primary low-pass filter having a lag-lead characteristic, resistors $R_{2b}$, $R_{2b}$ and $R_{3b}$ and a capacitor $C_b$ form another primary low-pass filter having a lag-lead characteristic, and resitors $R_{6a}$, $R_{7a}$, and $R_{6b}$, $R_{7b}$ form respective constant multiplier circuits.

In the circuit of FIG. 4, it is assumed that $R_{4a}$, $R_{4b}=R_{5a}$, $R_{5b}$, and $R_8=R_9$. Hence, the transfer characteristic of the circuit is as indicated by the following equations (3) and (4):

$$-A' = \frac{R_6}{R_1+R_2} \cdot \frac{1+j\frac{\omega}{\omega_H}}{1+j\frac{\omega}{\omega_L}} \cdot A + \frac{R_6}{R_7}(A-B) \quad (3)$$

$$-B' = \frac{R_6}{R_1+R_2} \cdot \frac{1+j\frac{\omega}{\omega_H}}{1+j\frac{\omega}{\omega_L}} \cdot B + \frac{R_6}{R_7}(B-A) \quad (4)$$

In equations (3) and (4):

$$\omega_L = \frac{1}{C\left(\frac{R_1R_2}{R_1+R_2} + R_3\right)}$$

$$\omega_H = \frac{1}{CR_3}$$

where the suffices a and b for the resistors have been omitted.

Equations (3) and (4) correspond to equations (1) and (2), respectively.

Figure 5:
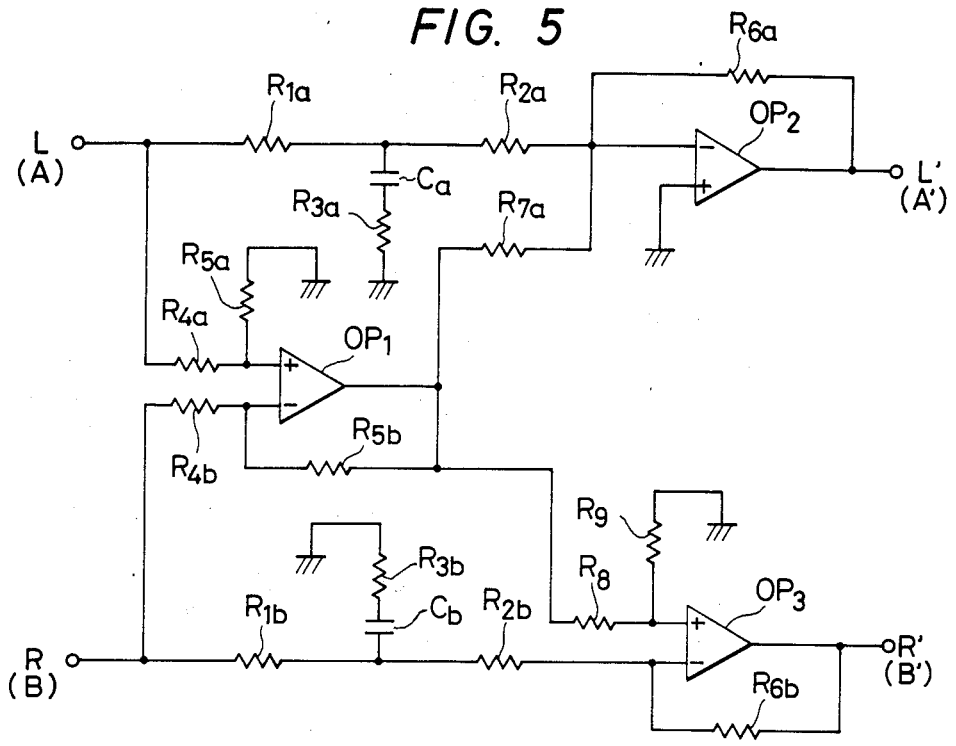
FIG. 5 is a circuit diagram, partly in the form of a block diagram, showing a modification of the circuit of FIG. 4.

FIG. 5 shows a modification of the circuit of FIG. 4 in which the noninverting input of the operational amplifier $OP_3$ is utilized to eliminate the operational amplifier circuit $OP_4$ forming the phase inverting circuit. In this modification, $R_2 >> R_1$, and the values of the resistors $R_8$ and $R_9$ are determined so that the difference signal mixing ratio is equal to that of the channel L.

Figure 6:
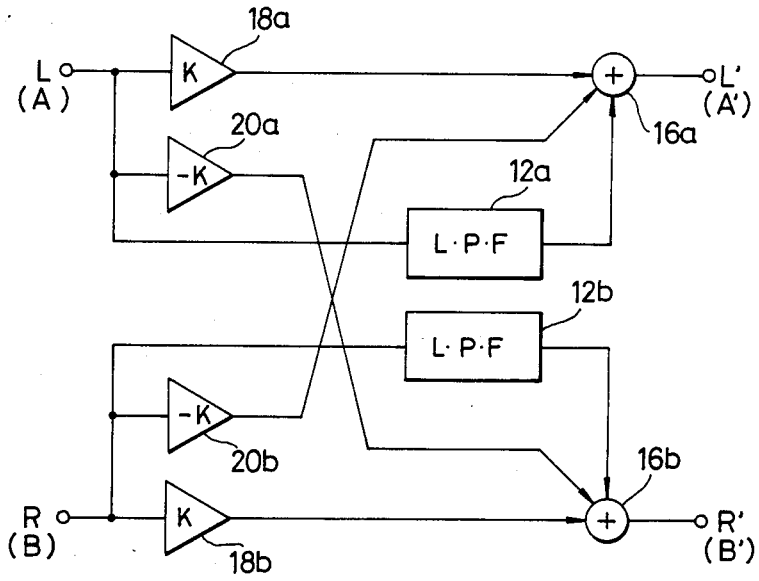
FIG. 6 is a block diagram showing another example of a stereo sound field enlarging circuit according to the invention.

FIG. 6 shows a second example of a stereo sound field enlarging circuit of the invention. In FIG. 6, reference characters L and R designate input terminals; L′ and R′, output terminals; 12*a* and 12*b*, low-pass filters having a lag-lead characteristic; 16*a* and 16*b*, adder circuits; 18*a* and 18*b*, constant multiplier circuits; and 20*a* and 20*b*, constant multiplier and phase inverting circuits.

Figure 8:
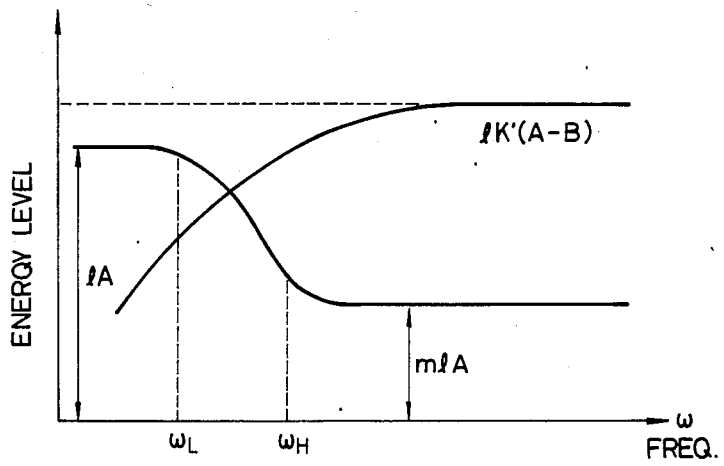
FIG. 8 is a graphical representation indicating the levels of signals processed in the circuit of FIG. 7.

In the circuit shown in FIG. 8, channel signals A and B, applied respectively to the input terminals L and R, are multiplied by a constant in the constant multiplier circuits 18*a* and 18*b*, the outputs of which are applied to first input terminals of the adder circuits 16*a* and 16*b*, respectively. The channel signals A and B applied to the input terminals L and R are applied to the low-pass filters 12*a* and 12*b*, respectively, where the high frequency components are attenuated. The outputs of the low-pass filters 12*a* and 12*b* are applied to second input terminals of the adder circuits 16*a* and 16*b*. Third input terminals of the adder circuits 16*a* and 16*b* receive the channels signals B and A, which are subjected to phase inversion and multiplication by a constant in the constant multiplier and phase inverting circuits 20*a* and 20*b*. The output signals of the circuits 12*a*, 18*a* and 20*b* and the output signals of the circuits 12*b*, 18*b* and 20*a* are mixed. The adder circuits 16*a* and 16*b* apply the resulting channel signals A′ and B′ to the output terminals L′ and R′, respectively.

In the circuit of FIG. 6 also, the above-described equations (1) and (2) are established, and the same effects as those of the first example of a stereo sound field enlarging circuit are obtained.

Figure 7:
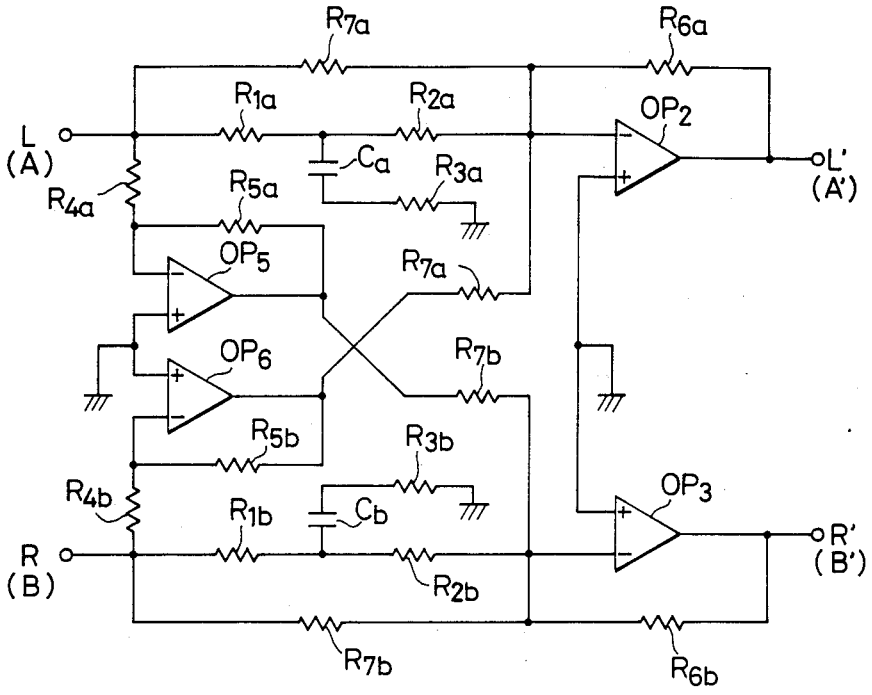
FIG. 7 is a circuit diagram, partly in the form of a block diagram, showing a specific implementation of the circuit shown in FIG. 6.

FIG. 7 shows the stereo sound field enlarging circuit of FIG. 6 in more detail. In FIG. 7, an operational amplifier $OP_5$ and resistors $R_{4a}$ and $R_{5a}$, and an operational amplifier $OP_6$ and resistors $R_{4b}$ and $R_{5b}$, for respective phase inverting circuits.

In the circuits of FIGS. 4, 5 and 7, the resistors $R_{3a}$ and $R_{3b}$ may be eliminated if it is permitted that reproduced voice and the like be somewhat low in localization.

Equations (3) and (4) can be rewritten as follows:

$$A' = l\left\{\left(\frac{1 + j\frac{\omega}{\omega_H}}{1 + j\frac{\omega}{\omega_L}}\right) A + K'(A - B)\right\} \quad (5)$$

$$B' = l\left\{\left(\frac{1 + j\frac{\omega}{\omega_H}}{1 + j\frac{\omega}{\omega_L}}\right) B + K'(B - A)\right\} \quad (6)$$

If $\omega << \omega_L$ in equation (5), then $$A' = l\{A + K'(A - B)\} \quad (7)$$

$$= l(1 + K')A - K'lB$$

If $\omega >> \omega_H$, then $$A' = l\{mA + K'(A - B)\} \quad (8)$$

$$= l(m + K')A - K'lB$$

where l, K' and m are constants. The constant m is represented by the following equation (9):

$$m = \frac{\omega_H + K'(\omega_H - \omega_L)}{\omega_L} \quad (9)$$

FIG. 8 is a graphical representation illustrating the above-described signal processing operation.

Figure 9:
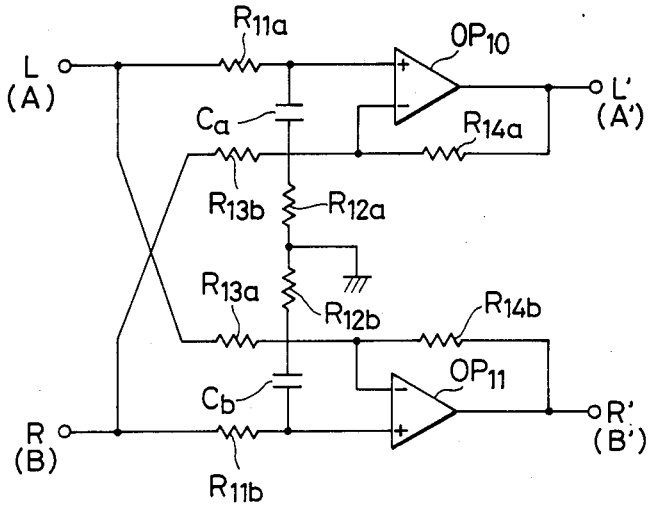
FIG. 9 is a circuit diagram, partly in the form of a block diagram, showing another example of a stereo sound field enlarging circuit according to the invention which provides the signals as shown in FIG. 8.

FIG. 9 shows a circuit which satisfies both equations (8) and (9). In FIG. 9, $OP_{10}$ and $OP_{11}$ designate operational amplifiers used to perform addition and subtraction. Resistors $R_{11b}$ and $R_{12b}$ and a capacitor $C_a$ form a primary low-pass filter having a lag-lead characteristic. Similarly, resistors $R_{11b}$ and $R_{12b}$ and a capacitor $C_b$ form another primary low-pass filter. Resistors $R_{13a}$, $R_{14a}$ and $R_{13b}$, $R_{14b}$ form respective constant multiplier circuits.

In the circuit of FIG. 9, with $\omega << \omega_L$, the signal A' of the output channel L' is:

$$A' = \left(1 + \frac{R_{14a}}{R_{13a}}\right) A - \frac{R_{14b}}{R_{13b}} B \quad (10)$$

With $\omega >> \omega_H$, the signal A' of the output channel L' is:

$$A' = \frac{R_{12a}}{R_{11a} + R_{12a}} \cdot \left(1 + \frac{R_{14a}}{R_{13a}}\right) A - \frac{R_{14b}}{R_{13b}} B \quad (11)$$

Combining equations (8) and (9) with equations (10) and (11), $$K'l = \frac{R_{14a}}{R_{13a}} = \frac{R_{14b}}{R_{13b}} \quad (12)$$

-continued $$l(1 + K') = \left(1 + \frac{R_{14a}}{R_{1b}}\right) \quad (13)$$

$$l(m + K') = \frac{R_{12a}}{R_{11a} + R_{12a}}\left(1 + \frac{R_{14a}}{R_{13a}}\right) \quad (14)$$

From equations (12) through (14), $$l = 1$$

$$K' = \frac{R_{14a}}{R_{13a}} = \frac{R_{14b}}{R_{13b}}$$

$$m = \frac{R_{12a} - K'R_{11a}}{R_{11a} + R_{12a}}$$

and $$\omega_L = \frac{1}{C_a(R_{11a} + R_{12a})}$$

$$\omega_H = \frac{1}{C_a(R_{12a} + R_{11a})}$$

$$= \frac{1}{mC_a(R_{11a} + R_{12a})}$$

According to experiments, the best results can be obtained with $K' = 1$ to 2, and $m = \frac{1}{2}$ to $\frac{1}{3}$, $\omega_L$ is set to a value in a range of about 500 to 600 Hz to 1,000 Hz.

Inserting the above-described constants into equations (5) and (6), the following equations are obtained:

$$A' = \frac{1 + j\omega mC_a(R_{11a} + R_{12a})}{1 + j\omega C_a(R_{11a} + R_{12a})} A + \frac{R_{14a}}{R_{13a}}(A - B)$$

$$B' = \frac{1 + j\omega mC_B(R_{11B} + R_{12B})}{1 + j\omega C_B(R_{11B} + R_{12B})} B + \frac{R_{14B}}{R_{13B}}(B - A)$$

In the above-described circuit, lag type low-pass filters may be employed in which m=0. However, in this case, the central localization component of voice, for instance, is in the relatively high frequency range, the perceived localization thereof is thus reduced.

The above-described stereo sound field enlarging circuit includes no delay circuit nor phase shifter. Accordingly, the circuit is simple in construction, low in manufacturing cost, and effective in the natural enlargement of a sound field.

Although the above-described circuit is simple in construction and produces the desired effect, frequency components lower than several hundred of hertz are not included in the difference signal (A−B), which is the residual component. That is, the larger part of the energy of the difference signal is in the middle and high frequency ranges. Accordingly, especially a female voice which should be centrally localized is liable to become unclear. This difficulty may be substantially eliminated by increasing the value of m and decreasing the value of K; however, doing so decreases the amount of sound field enlargement.

Figure 10:
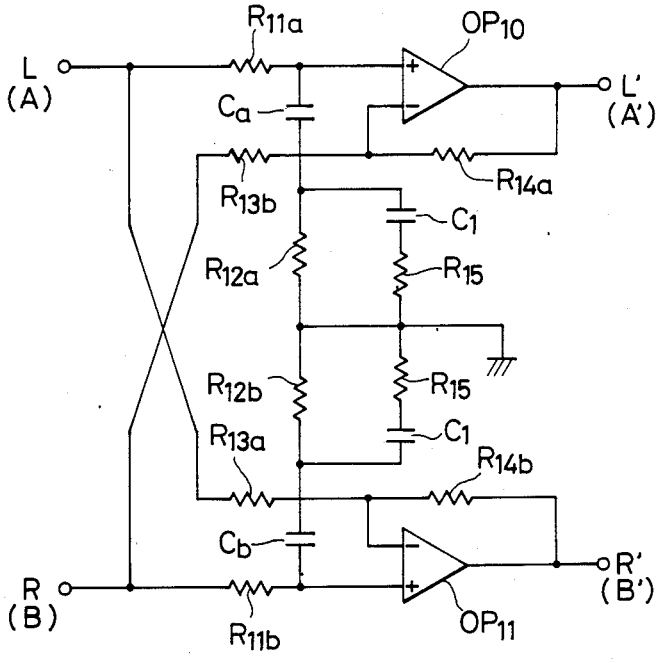
FIG. 10 is a circuit diagram, partly in the form of a block diagram, showing yet another example of a stereo sound field enlarging circuit according to the invention.

This problen is eliminated, however, in the embodiment of the invention shown in FIG. 10.

Figure 11:
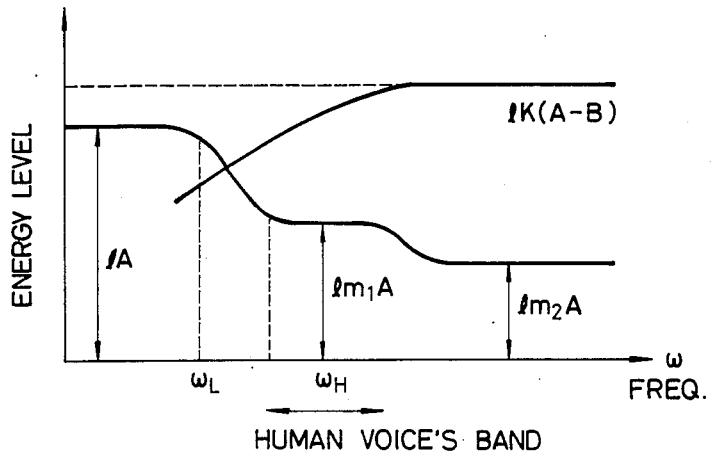
FIG. 11 is a graphical representation indicating the frequency distribution of the output signals of the circuit shown in FIG. 10.

The circuit of FIG. 10 is obtained by adding two lag-lead type filters, each of which includes a resistor $R_{15}$ and a capacitor $C_1$, to the circuit of FIG. 9. As the circuit includes the lag-lead type filters, a signal A', distributed as shown in FIG. 11, is provided at the output channel L'. In FIG. 11, $m_1$ designates the residual ratio of the original signal in the band of the human voice, and $m_2$, the residual ratio of the original signal in the high frequency range. The residual ratios $m_1$ and $m_2$ are represented by the following expressions:

$$m_1 = m = \frac{R_{12a} - KR_{11a}}{R_{11a} - R_{12a}}$$

$$m_2 = m = \frac{R_2' - KR_{11a}}{R_{11a} - R_2'}$$

where $R_2' = R_{12a}/R_{15}$

In the above-described example, the residual ratio $m_1$ in the human voice band is higher than that $m_2$ of the high frequency range, and therefore the clarity of the human voice is increased; however, the perceived sound field enlargement in this band is somewhat decreased.

Figure 12:
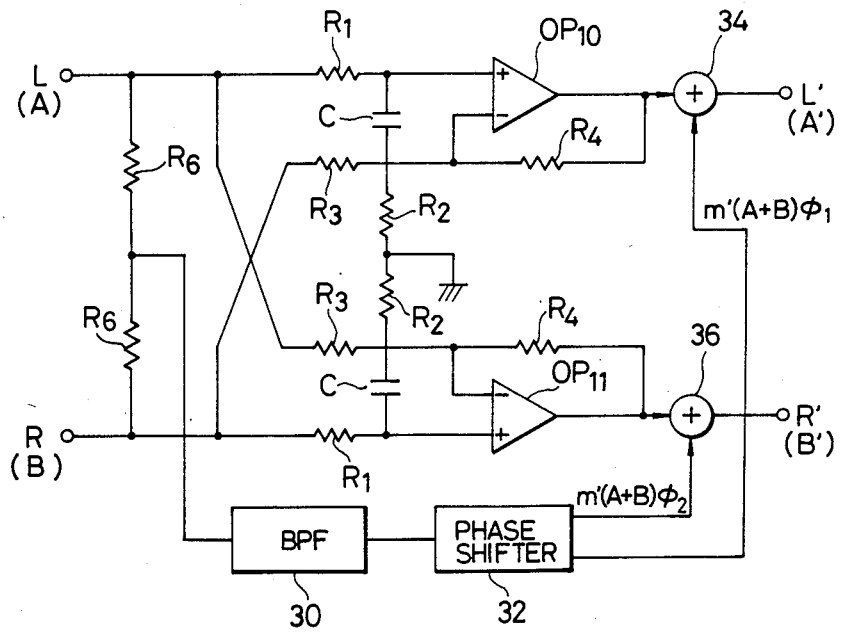
FIG. 12 is a circuit diagram, partly as a block diagram, showing still another example of a stereo sound field enlarging circuit according to the invention.

FIG. 12 shows another example of a stereo sound field enlarging circuit according to the invention. In the circuit of FIG. 12, the output signals of the operational amplifiers $OP_{10}$ and $OP_{11}$ in FIG. 10 are added, in a predetermined residual ratio, to the two signals different in phase from each other formed from the original signals A and B, thereby to obtain output channel signals A' and B'. The circuit includes a bandpass filter (BPF) 30 for transmitting the voice band component of the sum of the input signals A and B, a phase shifter for forming two signals $m'(A+B)\psi_1$ and $m'(A+B)\psi_2$ which differ from each other by about 90° in phase, an adder circuit 34 for adding the output of the phase shifter 32 to the output of the operational amplifier $OP_{10}$, and an adder circuit 36 for adding the output of the phase shifter 32 to the output of the operational amplifier $OP_{11}$.

Figure 13:
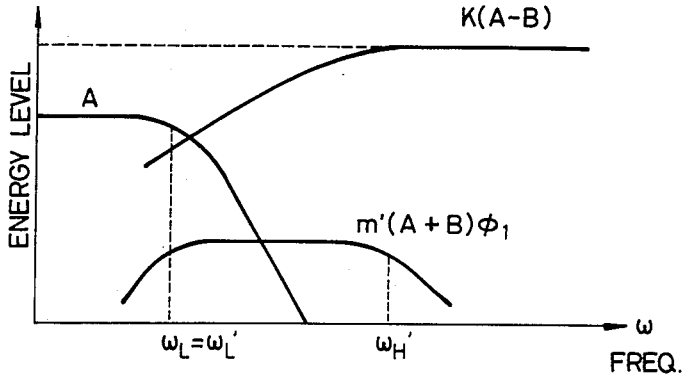
FIG. 13 is a graphical representation indicating the frequency distribution of the output signals of the circuit shown in FIG. 12.

The signal A' of the output channel L' in the circuit has a frequency distribution as shown in FIG. 13. In FIG. 13, $\omega_L'$ and $\omega_H'$ designate the cutoff frequencies of the bandpass filter 30, and m', the residual rate. The addition signals $m'(A+B)\psi_1$ and $m'(A+B)\psi_2$ determined by the factors $\omega_D'$, $\omega_H'$ and m' will not reduce the perception of sound field enlargement, being different by about 90° in phase from each other. Accordingly, the degree of clarity of the reproduced human voice can be increased by increasing the factor m'.

Figure 14:
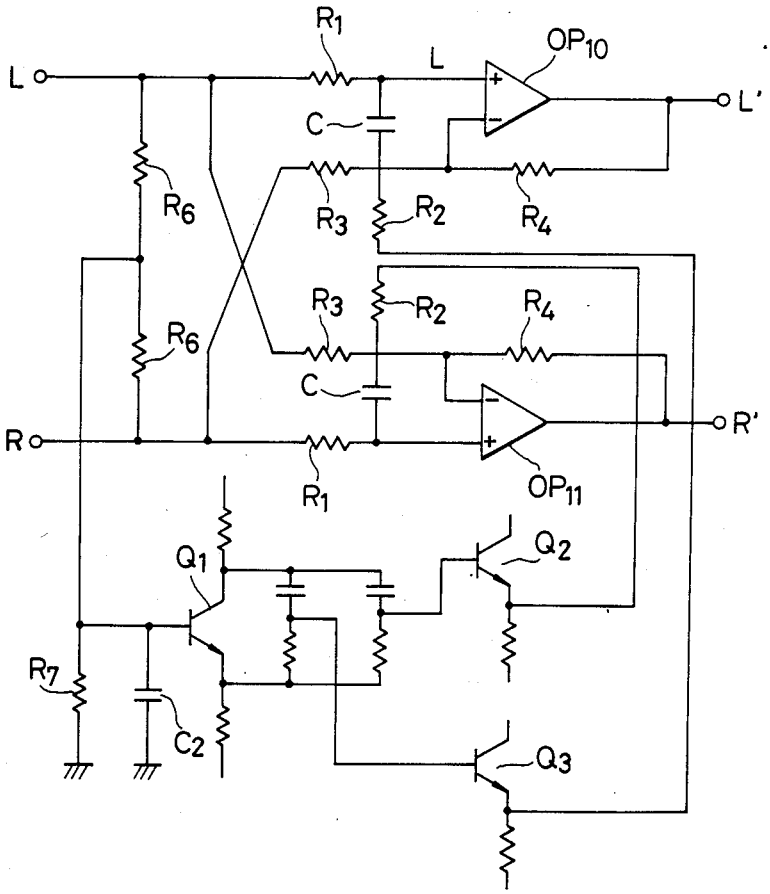
FIG. 14 is a circuit diagram, partly in the form of a block diagram, showing a specific implementation of the circuit shown in FIG. 12.

FIG. 14 illustrates an exemplary implementation of the circuit shown in FIG. 12. In the circuit of FIG. 14, a transistor $Q_1$ forms a phase shifter, and transistors $Q_2$ and $Q_3$ form respective buffers. A capacitor $C_2$ connected to the input of the transistor $Q_1$ forms a low-pass filter (LPF), and capacitors C connected in series with the outputs of the transistors $Q_2$ and $Q_3$ form respective high-pass filters (HPFs). These filters together form a bandpass filter (BPF). In the circuit of FIG. 14, the phase difference signal is applied to the noninverting input terminals of the operational amplifiers $OP_{10}$ and $OP_{11}$, thereby to eliminate the addition circuits 34 and 36 of FIG. 12.

In the circuit of FIG. 14, the residual ratio m of the original signal in the middle and high frequency ranges is set to zero, i.e., $R_2 = KR_1$, and the phase difference voice signal band is subjected to addition in an addition ratio m'.

The value m' is represented by the following equation:

$$m' = \frac{R_6R_7}{R_6(R_6 + R_7) + R_6R_7} \cdot \frac{R_1}{R_1 + R_2}(1 + K)$$

In the equation, $R_2 = KR_1$, and therefore $$m' = \frac{R_7}{R_6 + 2R_7}$$

The cutoff frequencies $\omega_L'$ and $\omega_H'$ of the bandpass filters are:

$$\omega_L' = \frac{1}{C(R_1 + R_2)} = \omega_L$$

$$\omega_H' = \frac{1}{\frac{R_6R_7}{R_6 + 2R_7} \cdot C_2} = \frac{1}{m'R_6C_2}$$

Thus, $\omega_L'$ is equal to $\omega_L$ in equations (5) and (6).

The circuit of FIG. 14 uses a bandpass filter in order to process the voice frequency band. However, the bandpass filter may be eliminated if the circuit is not limited to this band.

In this circuit, the sum signal (A+B) of the right and left channels is processed; however, an effect acceptable in some cases can be obtained by processing only the input signal of one of the channels.

In general, frequency components lower than several hundred hertz are not contained in the difference signal, but rarely the difference signal may contain low frequency components. In the latter case, components other than the reverberation components are subjected to addition and subtraction, and therefore the listener may perceive the sound field enlargement as being unnatural. However, such a problem can be resolved by applying the difference signal.

As is apparent from the above description, according to the invention, the residual ratio of the band component in the original signal, which is to be emphasized in localization, is increased. Therefore, the degree of clarity can be increased without disturbing the perception of natural sound field enlargement.

I claim:

1. In a stereo sound field enlarging circuit in which signals A and B applied to two input terminals are processed to provide signals A' and B' at two respective output terminals, the improvement comprising: means, including a first and a second low pass filter, for producing said signals A' and B' from said signals A and B in accordance with the following equations, $$A' = |A|_{LPF} + K(A - B)$$

$$B' = |B|_{LPF} + K(B - A),$$

where $|A|_{LPF}$ is the signal A passed through said first low-pass filter, $|B|_{LPF}$ is the signal B passed through said second low-pass filter, and K is a constant, said first and second low pass filters being respectively connected to said first and second input terminals and receiving said signals A and B; difference circuit means connected between said two input terminals for producing a difference signal (A−B); multiplier means for multiplying said difference signal to produce multiplied difference signals K (A−B) and K (B−A), where K is a constant; first adder circuit means for receiving the multiplied signal K (A−B) and the output of the first low pass filter for producing output signal A′; and second adder circuit means for receiving the multiplied difference signal K (B−A) and the output of said second low pass filter to produce said signal B′.

2. The stereo sound field enlarging circuit as claimed in claim 1, in which each said low-pass filter is a lag-lead characteristic primary low-pass filter.

3. The stereo sound field enlarging circuit as claimed in claim 1, in which each said low-pass filter is a lag characteristic primary low-pass filter.

4. The stereo sound field enlarging circuit as claimed in claim 2, in which said lag-lead characteristic primary low-pass filter comprises a filter providing a residual ratio of a band to be emphasized for localization, which ratio is larger than those of other bands.

5. The stero sound field enlarging circuit as claimed in claim 1, further comprising means for producing two signals having a phase difference therebetween from a band component of said original signals A and B to be emphasized for localization, and means for adding said two signals in a predetermined residual ratio to said signals A′ and B′.

6. The stereo sound field enlarging circuit as claimed in claim 1, wherein said first and second low pass filters pass frequencies only below 300 Hz, and wherein the majority of the frequency range of the difference signal (A−B) is above 1,000 Hz.

7. The stereo sound field enlarging circuit as claimed in claim 6, wherein K is in the range of 1 to 2.

* * * * *